US011718966B2

(12) United States Patent
Liberto

(10) Patent No.: US 11,718,966 B2
(45) Date of Patent: Aug. 8, 2023

(54) MODULE FOR ROAD SAFETY BARRIER AND SAFETY BARRIER MADE WITH SAID MODULE

(71) Applicant: Giuseppe Giovanni Liberto, Syracuse (IT)

(72) Inventor: Giuseppe Giovanni Liberto, Syracuse (IT)

( * ) Notice: Subject to any disclaimer, the term of this patent is extended or adjusted under 35 U.S.C. 154(b) by 191 days.

(21) Appl. No.: 17/420,782

(22) PCT Filed: Jan. 9, 2020

(86) PCT No.: PCT/IB2020/050140

§ 371 (c)(1),
(2) Date: Jul. 6, 2021

(87) PCT Pub. No.: WO2020/144610

PCT Pub. Date: Jul. 16, 2020

(65) Prior Publication Data

US 2022/0064882 A1 Mar. 3, 2022

(30) Foreign Application Priority Data

Jan. 10, 2019 (IT) ..... 102019000000409

(51) Int. Cl.
*E01F 15/04* (2006.01)

(52) U.S. Cl.
CPC ..... *E01F 15/0438* (2013.01); *E01F 15/0423* (2013.01); *E01F 15/0453* (2013.01)

(58) Field of Classification Search
CPC ..... E01F 15/08; E01F 15/081; E01F 15/085; E01F 15/086; E01F 15/088; E01F 15/02;
(Continued)

(56) References Cited

U.S. PATENT DOCUMENTS 5,118,216 A * 6/1992 Smith ..... E01F 15/083 404/6
2007/0187661 A1* 8/2007 Cheng ..... E01F 15/0453 256/19

FOREIGN PATENT DOCUMENTS

CH 618488 A5 7/1980
DE 19934659 A1 1/2001
(Continued)

OTHER PUBLICATIONS

Stern, Claudio, "International Search Report and Written Opinion of the international Searching Authority for International Application No. PCT/IB2020/050140," European Patent Office, dated Mar. 24, 2020.

*Primary Examiner* — Jonathan P Masinick
(74) *Attorney, Agent, or Firm* — Florek & Endres PLLC

(57) ABSTRACT

The present invention relates to a module for a road safety barrier (11) comprising essentially a main protection body (12) adapted to be coupled and constrained to at least two support uprights (13) fixed and constrained to the road surface or in the ground immediately adjacent to said road surface, in which said main protection body (12) has an upturned L shaped section to be arranged on said uprights (13) and fixed to them and in which said main protection body (12) has, in its front surface facing outwards, opposite to that facing said uprights (13), at least two wave-shaped enlargements (14) which proceed horizontally and parallel to the ground, said main protection body (12) being made from a special composite material, in which the matrix used for its realisation comes from raw materials recycled from used tyres, that is from the mixing of rubber powder and/or granules containing other recycled plastic materials and their related binders.

14 Claims, 10 Drawing Sheets

(58) Field of Classification Search
CPC ..... E01F 15/025; E01F 15/04; E01F 15/0407; E01F 15/0423; E01F 15/0438; E01F 15/0453
USPC ..... 256/13.1
See application file for complete search history.

(56) References Cited

FOREIGN PATENT DOCUMENTS

| | | | | | |
|---|---|---|---|---|---|
| DE | 102008039849 | B3 | * | 10/2009 | ..... E01F 15/0423 |
| EP | 0472847 | A2 | * | 3/1992 | |
| EP | 0519851 | A1 | * | 12/1992 | |
| EP | 0683272 | A2 | | 11/1995 | |
| EP | 1666667 | A2 | | 6/2006 | |
| ES | 2332553 | A1 | | 2/2010 | |
| ES | 2339413 | A1 | | 5/2010 | |
| ES | 2382290 | A1 | | 6/2012 | |
| FR | 2460365 | A1 | | 1/1981 | |
| FR | 2546932 | A1 | * | 12/1984 | |
| KR | 20100007313 | U | * | 7/2010 | |
| KR | 20130019483 | A | * | 2/2013 | |
| WO | WO-2005021872 | A2 | * | 3/2005 | ..... E01F 15/043 |

* cited by examiner

MODULE FOR ROAD SAFETY BARRIER AND SAFETY BARRIER MADE WITH SAID MODULE

The present invention relates to a module for road safety and a safety barrier made with this module.

Road safety barriers (side or central barriers) known and used today belong to the class of passive restraint devices installed to prevent vehicles from leaving the roadway.

In fact, on particularly dangerous roads, due both to their natural conformation and the quantity of traffic, special barriers are installed to prevent vehicles generally from leaving the roadway, whether with two or more axles (light and heavy vehicles), cars or two-wheel vehicles.

The current barriers are intended firstly to limit the effects of an impact on the occupants of the vehicles, at the same time preventing the involvement of persons or objects located outside the infrastructure.

Furthermore, currently these barriers are designed, in relation to the reference regulations, to meet the requirements of containment and to guarantee the performances defined according to the acceptance criteria measured by appropriate impact tests.

In the state of the art, road safety barriers are made from structural steel elements connected to each other. Furthermore they have geometrical and size characteristics that are suitably designed to meet the impact severity indexes, the useful width of the system and the deformation of the passenger compartment within the acceptable limits set in the regulations in force. Currently, for sizing road safety barriers, reference is made mainly to vehicles with four axles (light and heavy vehicles), while the sensitivity to, and therefore the creation of, appropriate protection for motorcyclists, has been little developed.

Moreover, it should be noted that a very high percentage of road deaths concerns specifically the drivers of two-wheel vehicles, which thus determines an unacceptable cost in terms of human lives. Furthermore, statistically, following the impact of a car with existing safety barriers, steel components penetrating inside the passenger compartment lead to injuries which are often fatal. In some cases, moreover, due to the characteristics of the materials and geometry of the materials used and the excessively high energy class to be contained for which some barriers are designed, oversized structures are often installed. These structures, when hit by light vehicles, often cause significant injuries to the vehicle occupants, linked precisely to the "strength" of the barrier itself. A barrier made in this way, as a protection element, may therefore even become an element of injury, even though not deliberately.

The underlying problem of the present invention is therefore that of making a road safety barrier that is able to overcome the limits of the prior art in a simple, reliable and cheap manner.

Within the scope of this problem, an object of the present invention is that of creating a protection that does not cause a risk of injury, even if involuntary, both for users of vehicles with at least four wheels and users of motorcycles.

In particular, another object of the present invention is to make a road safety barrier that in some way is able to prevent or at least limit the effects of impacts, perhaps also according to the forces transmitted and put into play.

According to a first aspect thereof, a module for a road safety barrier comprises essentially a main protection body adapted to be coupled and constrained to at least two support uprights fixed and constrained to the road surface or in the ground immediately adjacent to said road surface, in which said main protection body has an upturned L-shaped section to be arranged on said uprights and fixed to them and in which said main protection body has, in its front surface facing outwards, opposite to that facing said uprights, at least two wave-shaped enlargements which proceed horizontally and parallel to the ground, said main protection body being made from a special composite material, in which the matrix used for its creation comes from raw materials recycled from used tyres, that is from the mixing of rubber powder and/or granules containing other recycled plastic materials and their related binders. Preferably, in a lower end of said main protection body there is also a strip or portion of a flat protection surface that extends towards the ground.

More preferably, energy dissipators are arranged in a module between said at least due uprights and said main protection body.

Advantageously, said energy dissipators are made in the same material as said main protection body and may be ring elements with quadrilateral or trapezoidal section which on opposite sides create a constraint on one side to a rear wall of said main protection body and on another opposite side to a surface of said upright.

Furthermore, preferably, in an upper surface of said main protection body a support surface is made for an energy generator.

Preferably, said energy generator consists of a module with integrated technology for the generation of energy from renewable sources.

Preferably, in an upper front part of said main protection body a housing is made to receive and fix a light bar with micro leds.

Advantageously, opposite ends of said main protection body have, in an upper portion, a seat and respectively a housing which are complementary to each other in order to ensure the stable coupling of modules arranged and aligned to each other in succession.

A second aspect of the invention also relates to a safety barrier made with one or more modules according to one or more of the preceding characteristics.

The present invention may have at least one of the preferred features listed above; the latter may in particular be combined with one another as desired in order to meet specific application needs.

The invention therefore relates to a module for road safety and a safety barrier made with this module according to claim 1 and the subsequent dependent and independent claims. Further characteristics and advantages of the present invention will be more evident from the following description of some preferred embodiments thereof made with reference to the appended drawings.

The different features in the individual configurations can be combined with each other as preferred according to the previous description, should it be necessary to avail of the advantages resulting specifically from a particular combination.

In such drawings.

Figure 1:
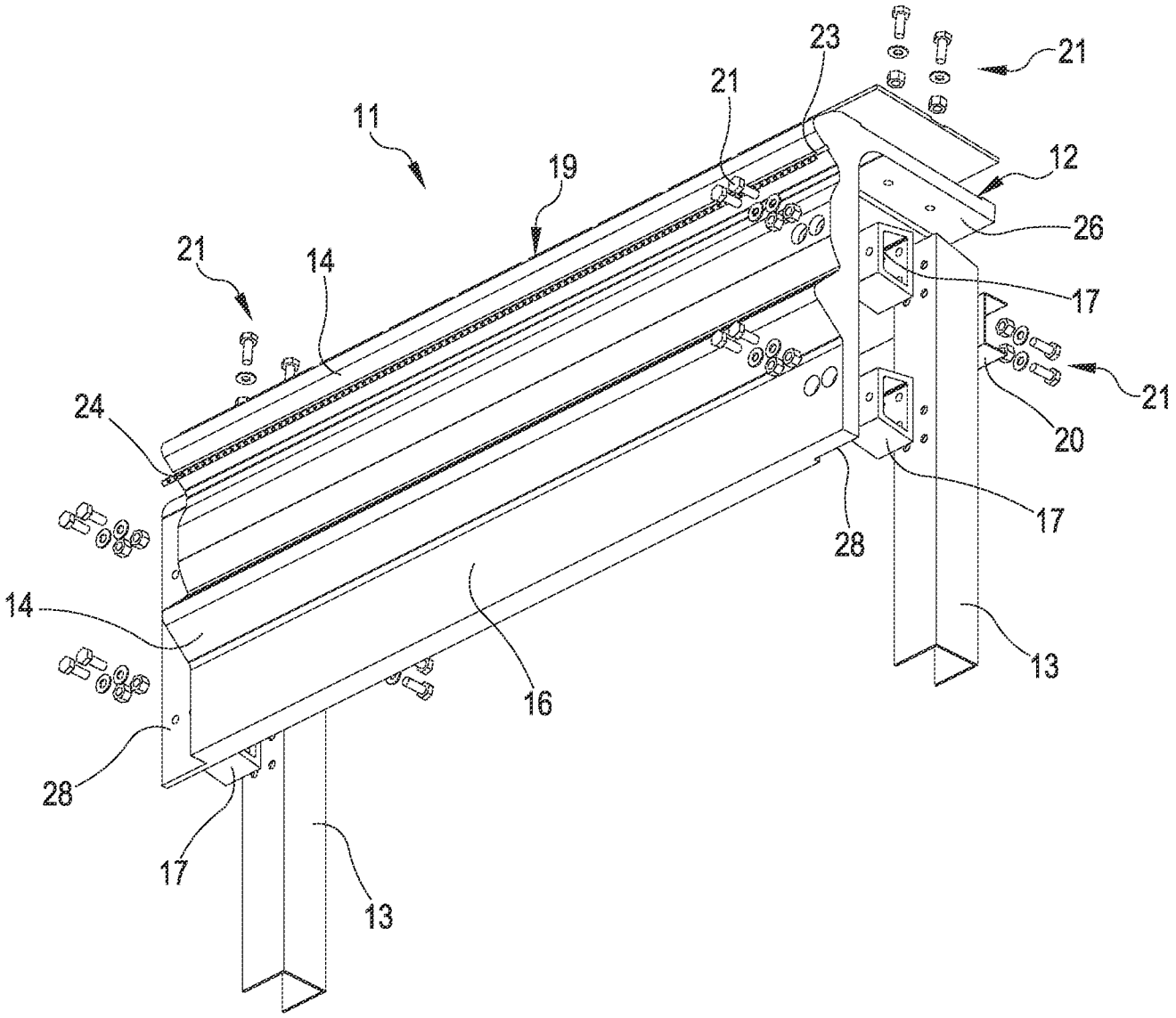
FIG. 1 is a front axonometric view from below with exploded parts of a preferred embodiment of a module for road safety according to the present invention ready for being assembled in an operational configuration.
Figure 2:
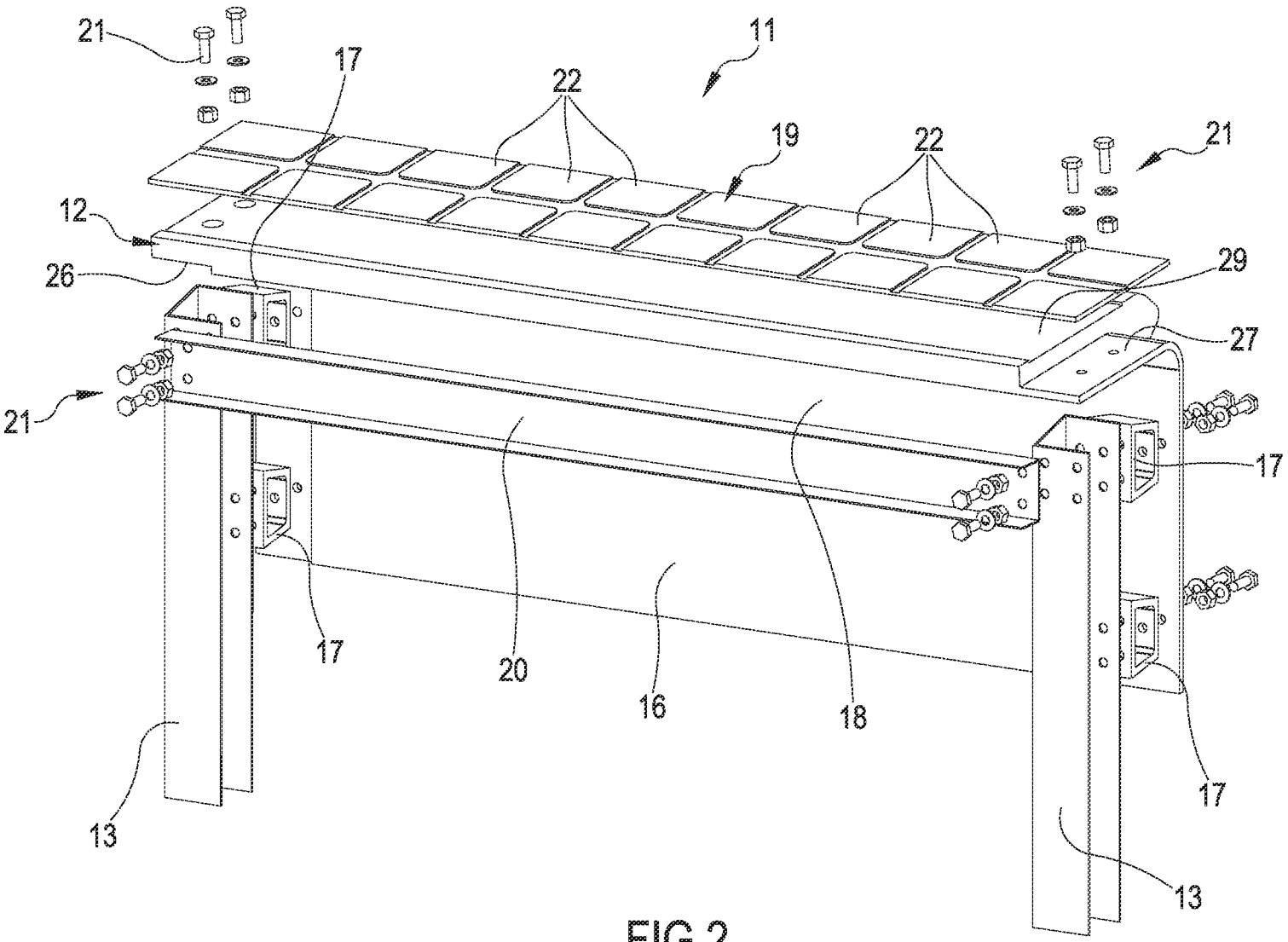
FIG. 2 is a rear axonometric view from above with exploded parts of a preferred embodiment of the module for road safety according to the present invention shown in FIG. 1.
Figure 3:
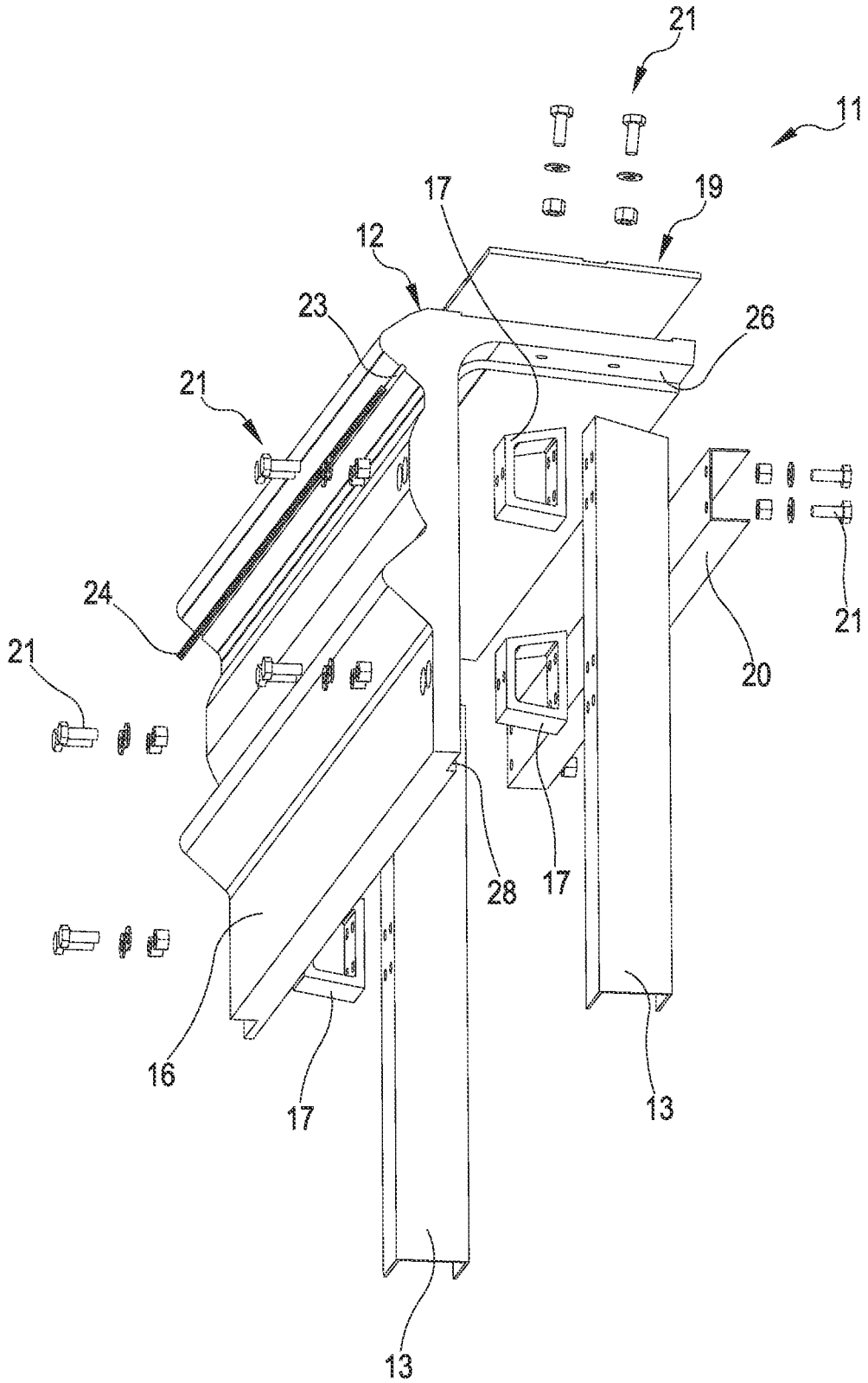
FIG. 3 is a side axonometric view from below with exploded parts of a preferred embodiment of the module for road safety according to the present invention shown in FIG. 1.
Figure 4:
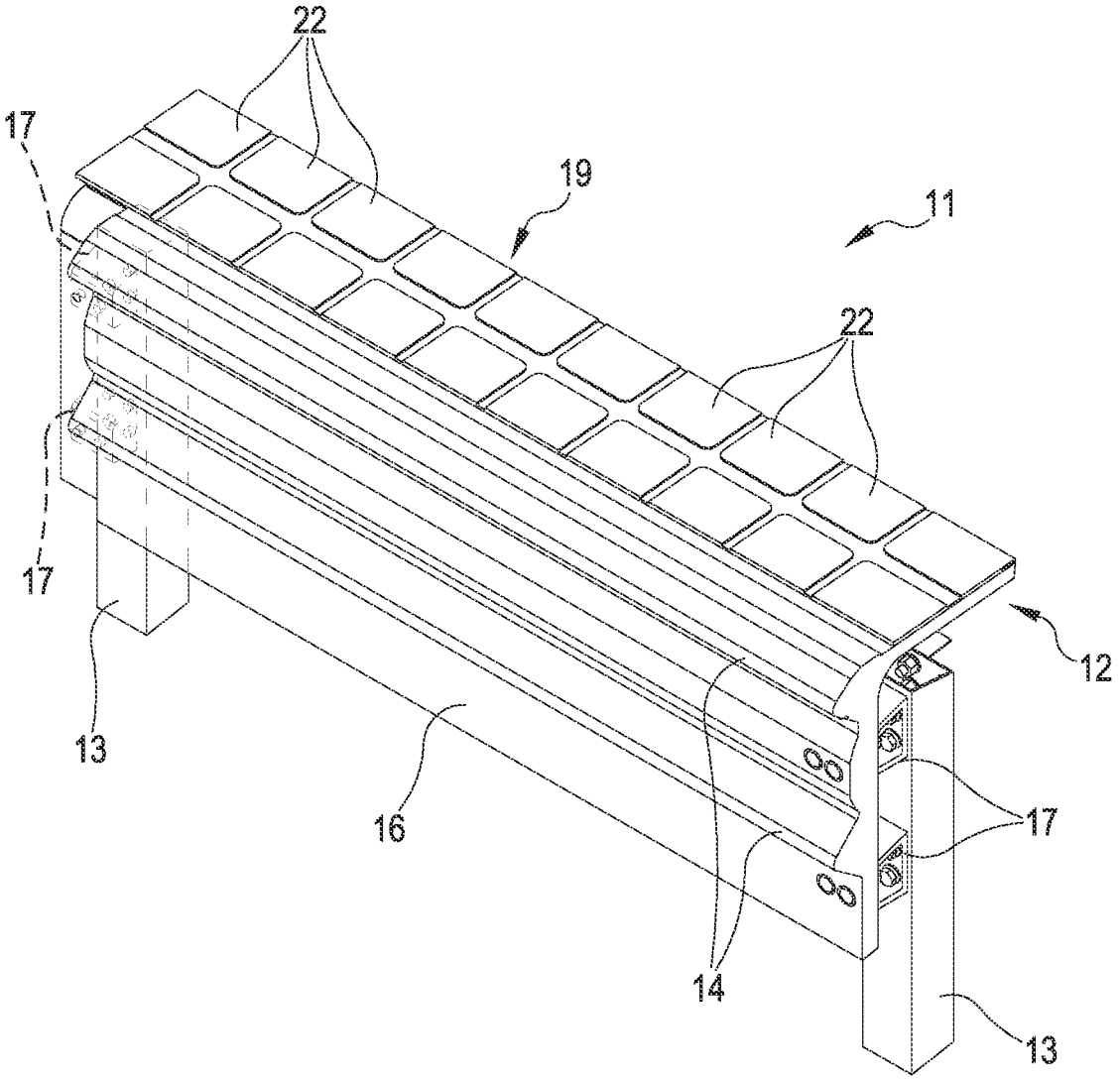
FIG. 4 is a front axonometric view from above of the preferred embodiment of the module for road safety according to the present invention shown in FIG. 1 fully assembled.

FIGS. 6-10 correspond to FIGS. 1-5 where the uprights 13 are represented in the operational configuration, that is underground.

For the illustration of the drawings, use is made in the following description of identical numerals to indicate construction elements with the same function. Further, for illustration clarity, some numerical references may not be repeated in all the figures.

Indications such as "vertical" and "horizontal", "upper" and "lower" (in the absence of other indications) are to be read with reference to the assembly (or operational) conditions and with reference to the normal terminology used in current language, where "vertical" indicates a substantially parallel direction to that of the gravitational force vector "g" and horizontal to a direction perpendicular thereto.

With reference to FIGS. 1 to 4 a preferred embodiment, which is to be understood as exemplifying and not limiting, of a module for road safety according to the present invention is shown, generally indicated by 11.

In the figures, this module for road safety 11 comprises essentially a main body 12 adapted to be coupled and constrained to at least two support uprights 13 fixed and constrained to the road surface or in the ground immediately adjacent to it.

According to the scope of the invention, the main body 12 is made from a special composite material, in which the matrix used for its creation comes from raw materials recycled from used tyres, that is the mixing of rubber powder and/or granules containing other recycled plastic materials and the relative binders. Alternatively, this matrix may contain a structural reinforcement, made from ferrous materials arranged longitudinally and/or transversally, aiming to increase the resistance in the main directions of impact.

In particular, said main protection body 12 has an upturned L shaped section in order to be arranged on the uprights 13 and its front surface facing outwards, opposite to that facing the uprights 13, has a wave shape.

In the example shown, also in compliance with the regulations, there are at least two wave-shaped enlargements 14 with horizontal progression parallel to the ground. It can also be seen in the example how a differentiated arrangement of waves is envisaged comprising the two said wave-shaped enlargements 14 between which an additional third wave-shaped enlargement 15 is arranged, with smaller intermediate wave size, that enters into operation after the two wave-shaped enlargements 14 of a larger size have completed their task of absorption.

In a lower end of the main body 12 a strip or portion of flat protection surface 16 is also envisaged, which extends towards the ground and allows the impacts to be absorbed and prevents the impact of falling motorcyclists against the main uprights 13 of the formed road safety barrier.

The flat protection surface 16 of the module, perpendicular to the ground, extends along all the lower area to the road surface, totally isolating the contact/impact of the motorcyclists, during the phases of a potential fall or sliding, with the main steel uprights 13. This is highlighted in FIGS. 6-10 which correspond to the said FIGS. 1-5, but the uprights are represented already in the operational position, that is underground.

In the known manner, the uprights 13 are made in steel, and will be designed specifically to resist the most significant impacts. Where possible, existing uprights for barriers known and used today may also be re-used. The burying of the uprights 3 and/or the connections of the latter to the existing foundation structures shall be sized according to the degree of severity and containment, as imposed by road safety barrier design standards.

Before explaining other characteristics and advantages of the material used, it is specified that a module for road safety 11 according to the invention also envisages other improved characteristics that are unknown in the prior art.

Alternatively to installing only the main body 12, with an upturned L shaped section constrained directly to the uprights 13, in addition energy dissipators 17 are arranged in an intermediate position between the uprights 13 and the main body 12.

These energy dissipators 17 are for example ring elements with quadrilateral or trapezoidal section which on opposite sides create a constraint on one side to a rear wall 18 of said main protection body 12 and on another opposite side a surface of said upright 13. These energy dissipators 17 are made from a special composite material, for example with the matrix used for its creation coming from raw materials recycled from used tyres, that is the mixing of rubber powder and/or granules containing other recycled plastic materials and the relative binders. Also for said energy dissipators 17, alternatively, this matrix may contain a structural reinforcement, made from ferrous materials arranged longitudinally and/or transversally, aiming to increase the resistance in the main directions of impact.

These energy dissipators 14, in the event of an impact against the road safety barrier 11 are geometrically modified, with elastic behaviour, reaching up to the configuration of maximum deformation and absorption. It is then from this moment that the main body 12 will start to actively absorb energy, thus damping the impacts. It is therefore evident that envisaging these energy dissipators 17 interposed between the main body 12 and uprights 13 is particularly effectively able to ensure twice as much, differentiated and progressive absorption.

A further additional and particularly advantageous provision is that of positioning a support surface for an energy generator 19 on an upper surface 29 of the upturned L shaped main body 12. In particular this energy generator 19 may comprise a module with integrated technology for the generation of energy from renewable sources, for example with solar cells or panels 22.

The upturned "L" geometry thus allows the creation of said flat upper surface 29, parallel to or slightly inclined in relation to the road surface, usable as a support base of an energy generator, for example with thin film technology to be applied stably to said module. Unlike other technical solutions, the safety barrier module according to the present invention allows the creation of an integrated system for energy production, with undisputed significant advantages. The application of an energy generator from renewable sources on the module according to the invention lays the foundations for significant change in relation to the sustainable development of the planet. The application of a safety barrier made in this way, on a large scale in relation to the type of application, would allow a significant production of energy to be made available to the utilities along the trajectory of installation, such as for example, road lighting, to power charging stations for electric cars, for the general power supply to small plants situated in adjacent locations, etc.

It should also be noted how the uprights 13 are preferably connected to steel crossbeams or rails 20, arranged longitudinally, essentially parallel to the ground. These steel crossbeams or rails 20 are connected to the uprights 13 by bolts 21. The used of said rails 20 further improves the flexural loads acting on the safety barrier in the event of impact.

Furthermore, preferably these steel crossbeams or rails 20 can house the cables and connectors (not shown) of the various panel modules 22 forming part of the energy generator 19 with integrated technology for the generation of energy from renewable sources.

Additionally, in an upper front part of the main body 12 a special housing 23 is made (see FIG. 3) to fix a light bar with micro leds 24, which can also be powered by the energy generator 19. The light bar 24 will indicate the route and disseminate light on the white line (yellow line if temporary) delimiting the roadways. The light bar 24 will come on autonomously with integrated twilight-type sensor or alternative technology (not shown).

Figure 5:
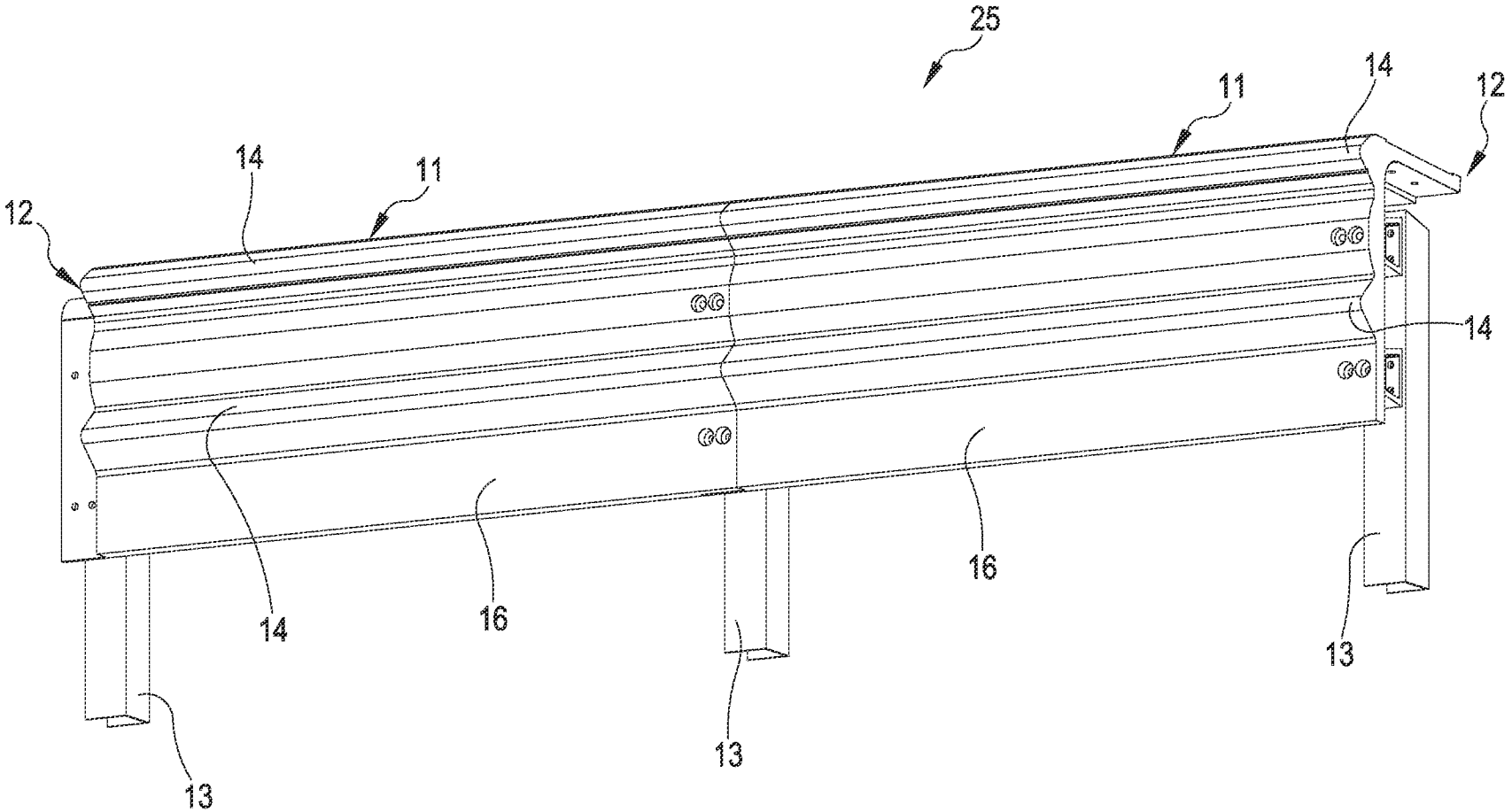
FIG. 5 is a front axonometric view of a pair of modules according to the present invention as shown in the preceding FIGS. 1-4 when connected to each other in order to create a stretch of road safety barrier.
Figure 6:
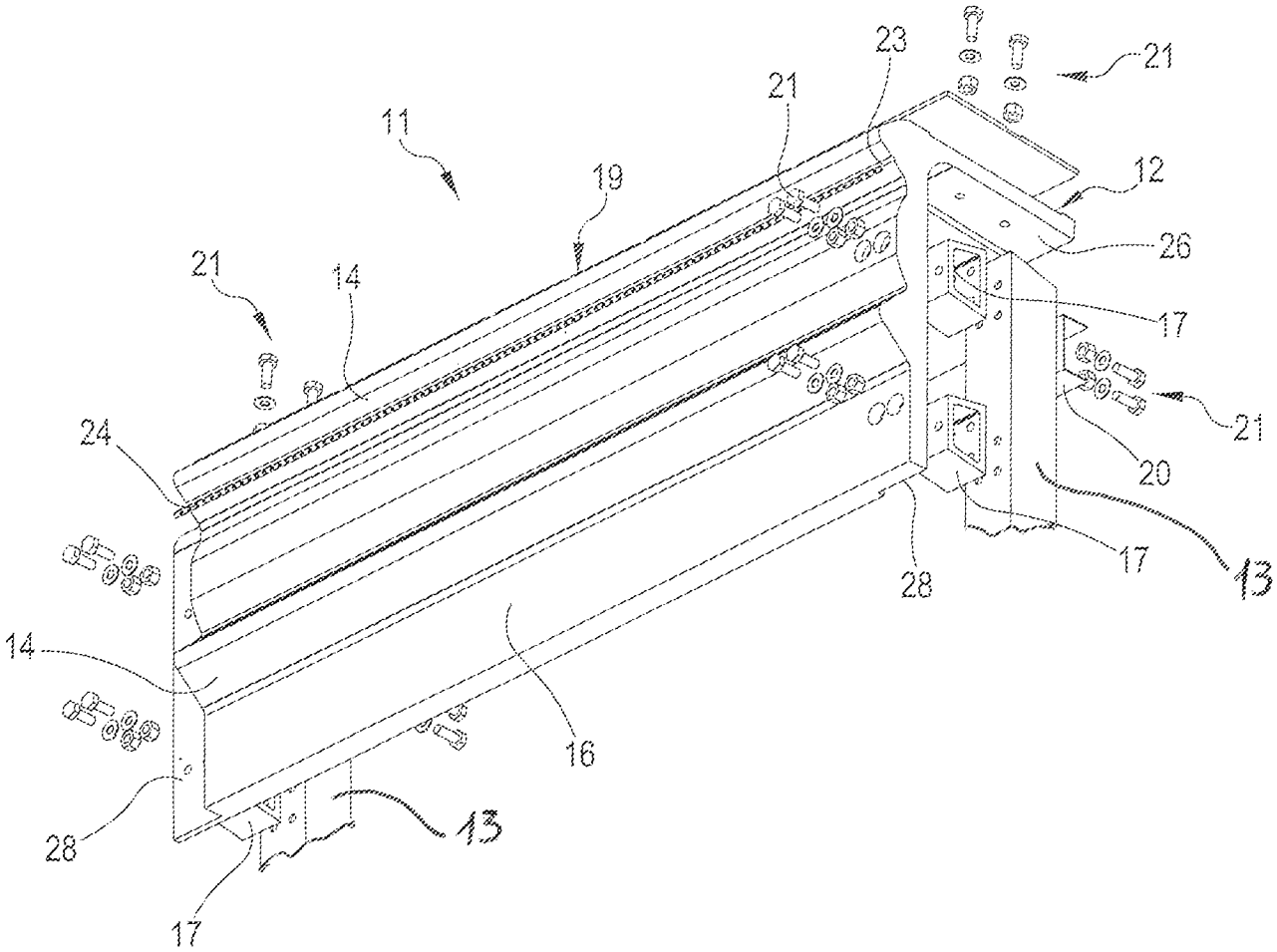
Figure 7:
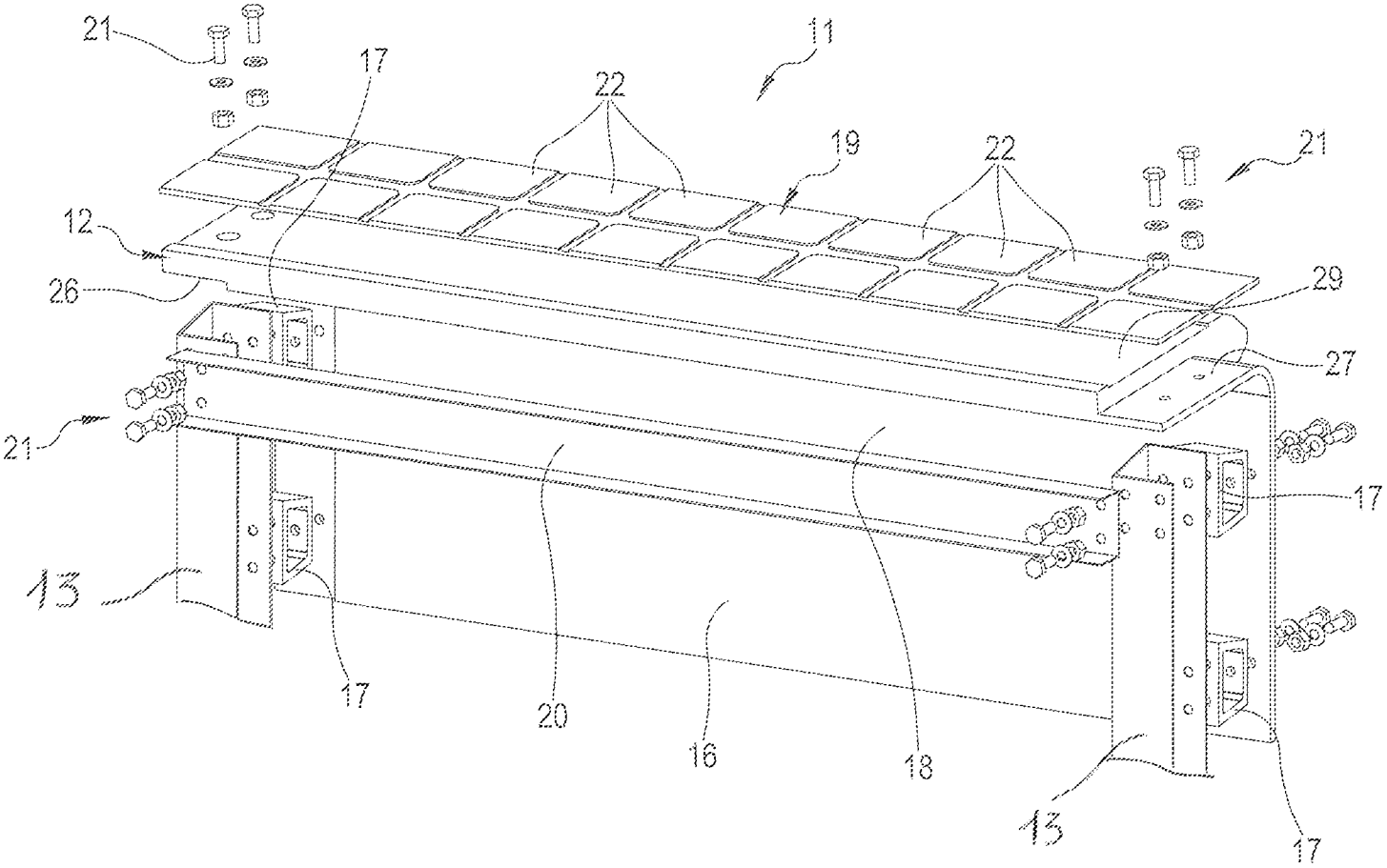
Figure 8:
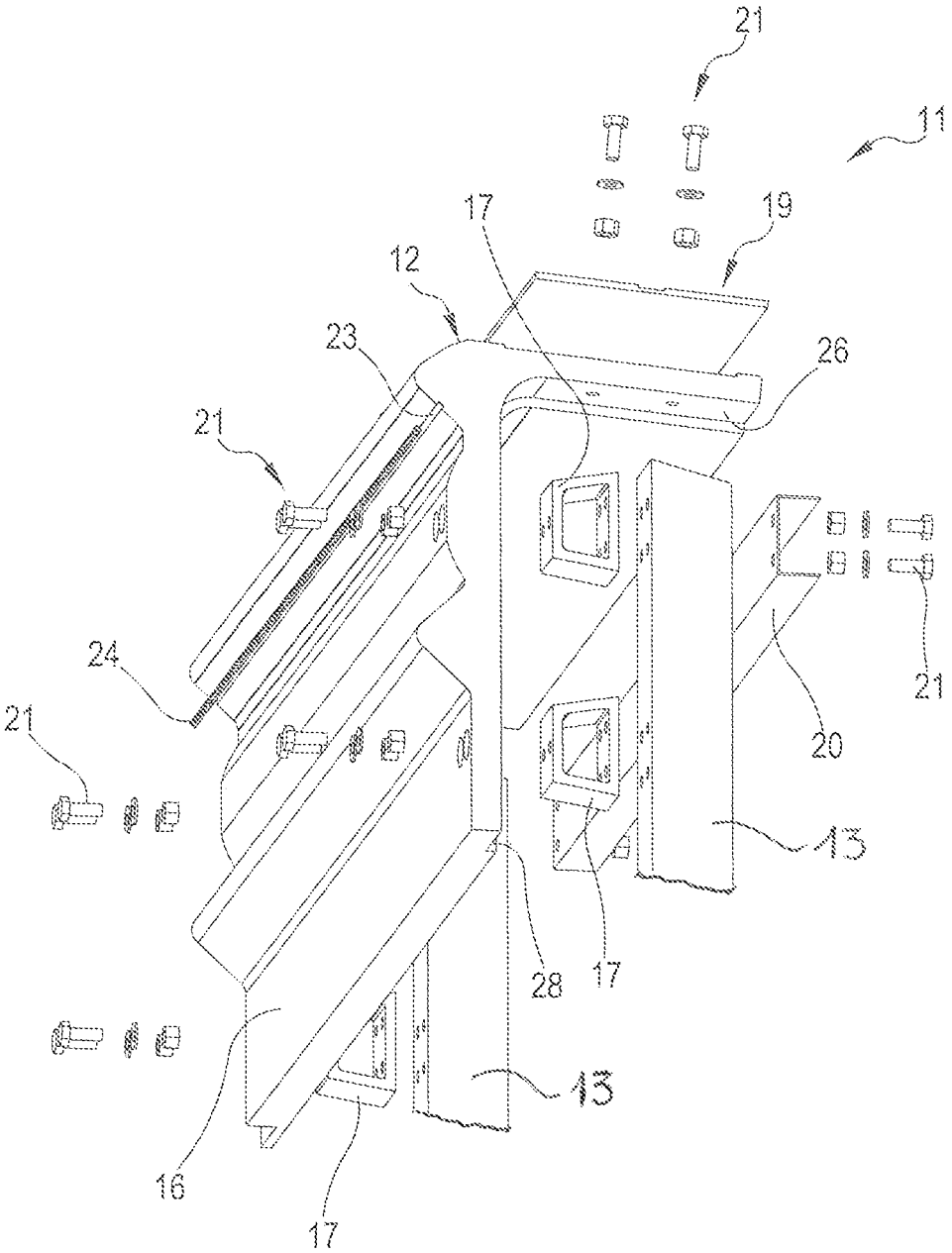
Figure 9:
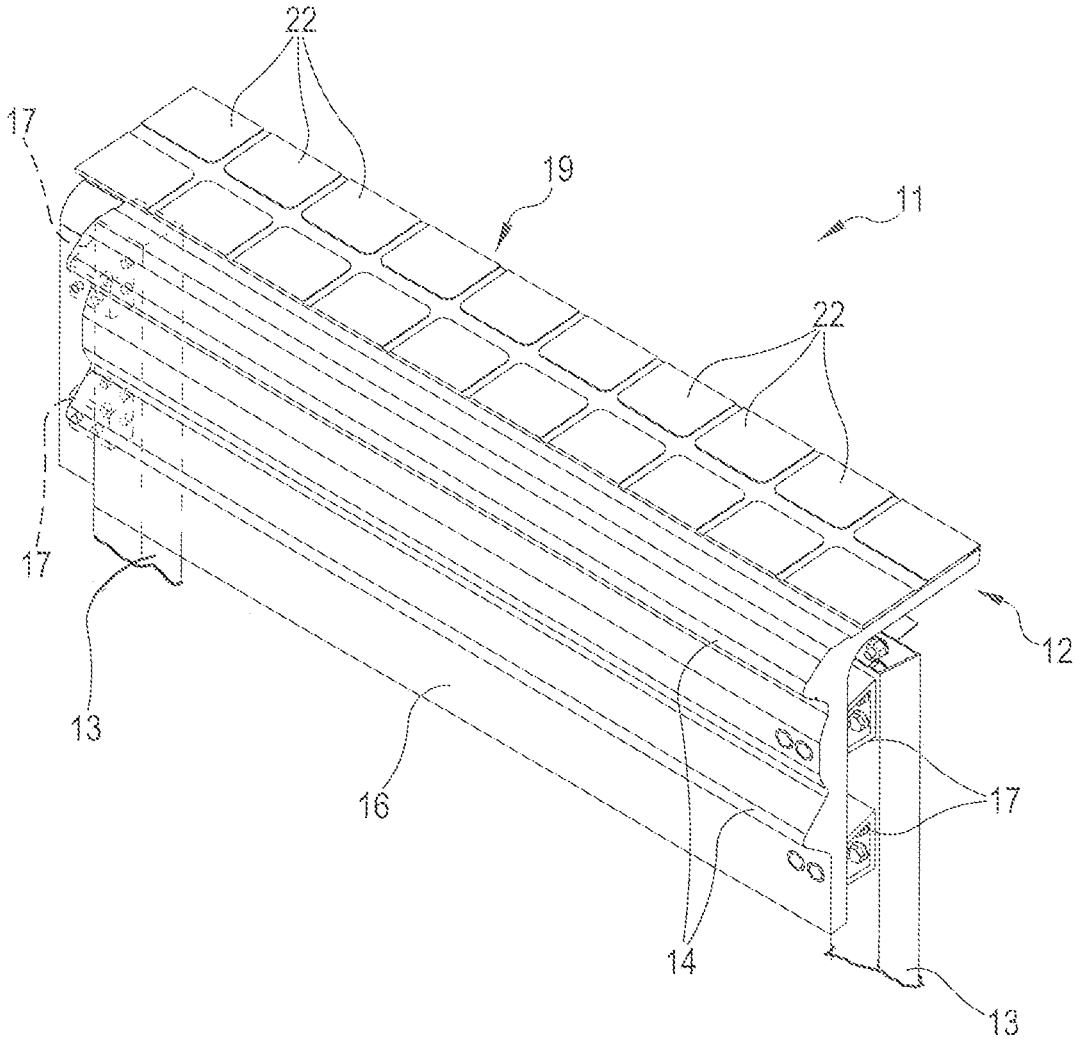
Figure 10:
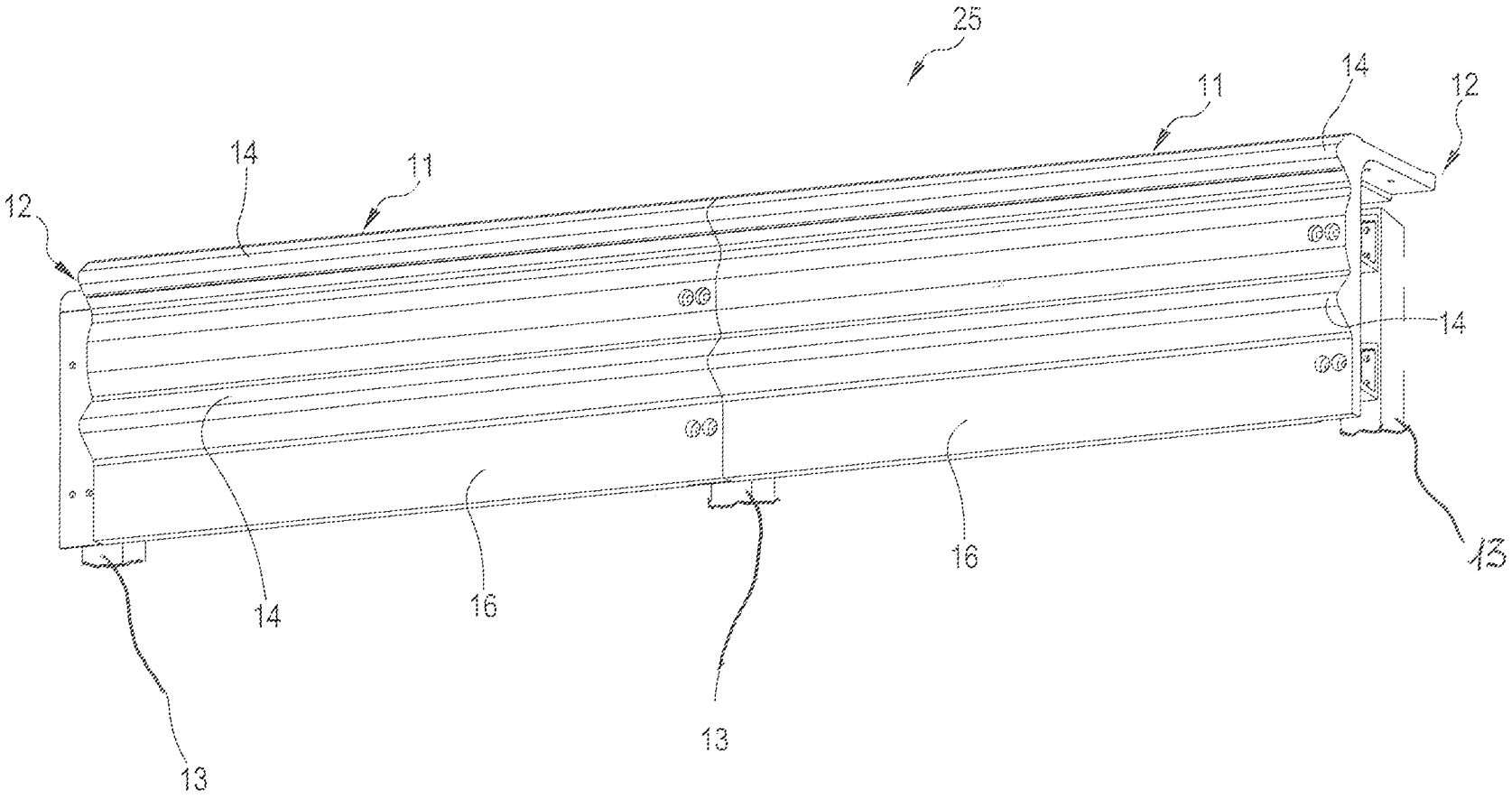

As explained initially, the preceding description was given in relation to a single module 11, but as shown in FIG. 5, putting together many modules 11 an actual road safety barrier 25 is created, also according to the present invention.

In this respect returning in particular to FIG. 2 it is shown how alternatively it is possible to envisage, on opposite ends of the main protection body 12, in an upper portion, a seat made in the rear 26 and a surface housing 27 which are complementary to each other to allow the stable coupling of the various modules 11 aligned and arranged in succession. The figure also shows how advantageously two subsequent modules 11 can be fitted with common intermediate bolts 21 acting on both modules 11.

To facilitate a stable connection between the main protection body 12 and the uprights 13 or in any case between subsequent uprights 13 at the rear of portions of said main protection body 12 it is possible to envisage further side drops 28 also in the vertical parts to improve the abutments and matching between the subsequent main bodies in relation to the uprights 13 themselves.

Generally, as described in the preceding example, the various elements and parts comprising the module according to the present invention are stably and permanently constrained by bolts 21 of the type mentioned for the assembly of the various components.

The various figures proposed are in themselves illustrative of how the stable coupling of the various parts of the single module 11 or between various modules 11 can be implemented in order to create a road safety barrier 25.

In devising this invention, particular attention was paid not only to the problems emerging from the prior art of road safety barriers, but also to the research of "raw" construction materials which could generally bring additional and specific advantages.

It has thus emerged advantageously from this creative and inventive effort that, having had to identify raw "material" different from the steel structures used until today, the orientation was towards plastic and/or rubber materials with particularly suitable absorption characteristics.

And precisely on the basis of this research it was advantageously found possible to use what mentioned above, that is a special composite material, in which the matrix used for its creation comes from raw materials recycled from used tyres, that is the mixing of rubber powder and/or granules containing other recycled plastic materials and the relative binders. The use of this composite material thus combines the advantages necessary to create a main body adapted to solve the problems of current barriers with the undisputed advantages of the recycling and recovery of materials which otherwise would be sent for destruction, with significant costs, at the same time avoiding phenomena of environmental pollution.

In this way a main construction material has been identified that possesses and combines truly important characteristics including:

compressive strength;
flexural strength;
resistance to corrosion;
creep resistance;
resistance to high and low temperatures;
resistance to ultra-violet radiation;
water resistance;
fire resistance and self-extinguishing capacity;

These new "construction materials" allow the significant reducing and damping of impacts, protecting the occupants of both vehicles with four axles, two axles as well as, in particular, motorcyclists.

The main body 12 and the energy dissipators 17 will be made using raw materials recycled from used tyres, with the following additional advantages:

- transformation of waste into an available resource;
- reduction of raw materials taken from nature, saving energy and water;
- minimisation of the quantities of waste to be disposed of, with significant advantages for health and the environment;
- possible reuse of a product deformed by an accident, including it in the production chain again as a "recyclable product".

Advantageously, there will necessarily be an increase in the alternative production sector, creating wealth and new jobs and promoting research and competitiveness in development. Preferably, it has been seen that said main body 12 is made with an "L" shape, with a perfectly smooth external surface or casing, and is formed of a monolithic element, of a suitable length and thickness, in which the front surface, exposed to impacts, has, as is shown, various wave-shaped enlargements. As has been seen, a lower area consists of a flat surface 16, which extends towards the ground of a size that preferably comes into contact with the ground, that is with the road surface, which absorbs impacts and prevents the impact of falling motorcyclists against the main uprights 13 of the road safety barrier. Advantageously, these module for road safeties form a road safety barrier with three degrees of movement-damping:

1) for impacts with light vehicles, at low speed, mainly the energy dissipators 17 bear the impacts;

2) for impacts with light vehicles at high speed, the energy dissipators 17 are geometrically modified, with elastic behaviour, reaching up to the configuration of maximum deformation. From this moment the main body 12 will start to actively absorb energy, thus damping the impacts;

3) overcoming the conditions referred to in points 1) and 2), for the purpose of mechanical strength, the uprights 13 and rails 20 come into play.

The many benefits deriving from the modules and the road safety barriers are thus shown. From the descriptions given, the characteristics of the rotary-linear actuation unit to which the present invention refers are clear, as are the relative advantages.

In addition to the above-described embodiment other variants are possible, without departing from the teaching of the invention.

Lastly, it is clear that a module for road safety and a safety barrier created with the module designed in this way are susceptible to numerous modifications and variants, without departing from the scope of the invention; moreover, all details can be replaced with technically equivalent elements. In practice, the materials used, as well as the dimensions, can be of any type according to the technical requirements.

The invention claimed is:

1. A module for a road safety barrier comprising a main protection body adapted to be coupled and constrained to at least two support uprights fixed and constrained to the road surface or in the ground immediately adjacent to said road surface, in which said main protection body has an upturned L shaped section to be arranged on said uprights and fixed to them and in which said main protection body has, in a front surface facing outwards, opposite to that facing said uprights, at least two wave-shaped enlargements which proceed horizontally and parallel to the ground, said main protection body being made from a special composite material, in which the matrix used for its realisation comes from raw materials recycled from used tyres, that is from the mixing of rubber powder and/or granules containing other recycled plastic materials and their related binders and wherein energy dissipators are arranged between said at least two uprights and said main protection body.

2. The module according to claim 1, in which in a lower end of said main protection body there is also a strip or portion of flat protection surface which extends towards the ground or is optionally in contact with it.

3. The module according to claim 1, in which a further third wave-shaped enlargement is envisaged, with smaller intermediate wave size between said at least two wave-shaped enlargements that enters into operation after said at least two wave-shaped enlargements of a larger size have completed their task of absorption.

4. The module according to claim 1, in which said energy dissipators are made in the same material as said main protection body.

5. The module according to claim 1, in which said energy dissipators are ring-shaped elements with quadrilateral or trapezoidal section which on opposite sides create a constraint on one side to a rear wall of said main protection body and on another opposite side to a surface of said upright.

6. The module according to claim 1, in which on an upper surface of said main protection body a support surface is created with an energy generator.

7. The module according to claim 6, in which said energy generator consists of a module with integrated technology for the generation of energy from renewable sources.

8. The module according to claim 6, in which in a top front part of said main protection body a housing is made to receive and fix a light bar with micro leds, preferably said light bar being powered by said energy generator.

9. The module according to claim 1, in which said composite material of said main protection body contains a structural reinforcement, made from ferrous materials arranged longitudinally and/or transversally, aiming to increase the resistance in the main impact directions.

10. The module according to claim 1, in which said composite material of said energy dissipators contains a structural reinforcement, made from ferrous materials arranged longitudinally and/or transversally, aiming to increase the resistance in the main impact directions.

11. The module according to claim 1, in which said at least two uprights are connected to steel crossbeams or rails, arranged longitudinally, essentially parallel to the ground.

12. The module according to claim 1, in which opposite ends of said main protection body have in an upper portion, a seat made in a rear surface and a surface housing which are complementary to each other in order to ensure the stable coupling of modules arranged and aligned to each other in succession.

13. The module according to claim 12, wherein the rear surface of portions of said main protection body comprises side drops in vertical parts.

14. A road safety barrier made with one or more modules according to claim 1.

* * * * *